US005297726A

United States Patent [19]

Detzel

[11] Patent Number: 5,297,726

[45] Date of Patent: Mar. 29, 1994

[54] BOARD BLANK FOR THE PRODUCTION OF A FOLDING CARTON

[75] Inventor: Josef Detzel, Kempten, Fed. Rep. of Germany

[73] Assignee: Nicolaus Kempten GmbH, Kempten, Fed. Rep. of Germany

[21] Appl. No.: 25,840

[22] Filed: Mar. 3, 1993

[30] Foreign Application Priority Data

Mar. 12, 1992 [DE] Fed. Rep. of Germany ..... 4207870

[51] Int. Cl.[5] ..... B65D 5/24

[52] U.S. Cl. ..... 229/186; 229/3.1; 229/154

[58] Field of Search ..... 229/3.1, 141, 154, 186

[56] References Cited

U.S. PATENT DOCUMENTS

| | | | |
|---|---|---|---|
| 959,261 | 5/1910 | Reber | 229/186 |
| 3,146,933 | 9/1964 | Moore | 229/186 |
| 3,361,325 | 1/1968 | Hakansson et al. | 229/154 |
| 3,454,209 | 7/1969 | Persson | 229/186 |
| 3,545,665 | 12/1970 | Nimaroff | 229/186 |
| 3,812,641 | 5/1974 | Bemiss | 229/186 |
| 4,304,352 | 12/1981 | Humphries | 229/186 |
| 4,832,257 | 5/1989 | Wood | 229/186 |

FOREIGN PATENT DOCUMENTS

| | | | |
|---|---|---|---|
| 455610 | 11/1991 | European Pat. Off. | 229/186 |

*Primary Examiner*—Gary E. Elkins
*Attorney, Agent, or Firm*—Michael J. Striker

[57] ABSTRACT

A board blank for producing a folding carton, has a base panel having a plurality of sides, a plurality of side panels each hinged to a respective one of the sides of the base panel, a top panel hinged to one of the side panels, and a plurality of intermediate sections each located between and connecting two neihgboring ones of the side panels with one another. Each of the intermediate sections is foldable along a folding line which divides each of the intermediate sections into a first part located adjacent to one of the two neighboring side panels and a second part located adjacent to another of the two neighboring side panels. The first part of each of the intermediate sections is provided with a cut-out adjacent to the one neighboring side panel so that the second part of each of the intermediate sections rests against the one neighboring side panel when the intermediate sections are folded.

5 Claims, 2 Drawing Sheets

BOARD BLANK FOR THE PRODUCTION OF A FOLDING CARTON

BACKGROUND OF THE INVENTION

The invention relates to a board blank for the production of a folding carton, with a base, two side panels, a front panel an a back panel, that are hinged to the base, and a top panel hinged to the back panel, where the panels hinged to the base are connected by intermediate sections, each of which is divided by a folding line.

The intermediate sections are folded inwards and sealed to one of the outer panels in order to produce a stable and tight folding carton. Because of the material thickness in the area of the folded intermediate sections, it is difficult to seal the folding carton tightly. This is only possible if both the inside and the outside are provided with a sealable layer.

SUMMARY OF THE INVENTION

The purpose of the invention is to propose a board blank for the simple production of a folding carton, with which a folding carton can be erected and tightly sealed in its corners, even if only the inside is provided with a sealable layer.

In the solution to this problem proposed by the invention the intermediate sections are provided with a cut-out section in the area adjacent to the front panel and the back panel, so that the area of the intermediate sections adjacent to the side panels rests directly against the front panel and the back panel in the area of this cut-out section, when the intermediate sections are folded into position against the front panel and the back panel.

In accordance with the invention, this cut-out section is essentially rectangular, where one narrow side of this rectangle is next to the adjacent front panel or back panel, while the cut-out section is located on the outer edge of the intermediate section and is thus open towards the outside.

It has also provided to be very advantageous if in accordance with the invention the inner corner of the cut-out section on the opposite side from the front panel or the back panel is round in shape.

This feature enables the cut-out section to be made comparatively large and to extend it close to the folding line dividing the intermediate section.

BRIEF DESCRIPTION OF THE DRAWINGS

One embodiment of the invention is illustrated in the drawings.

DESCRIPTION OF THE PREFERRED EMBODIMENTS

Figure 1:
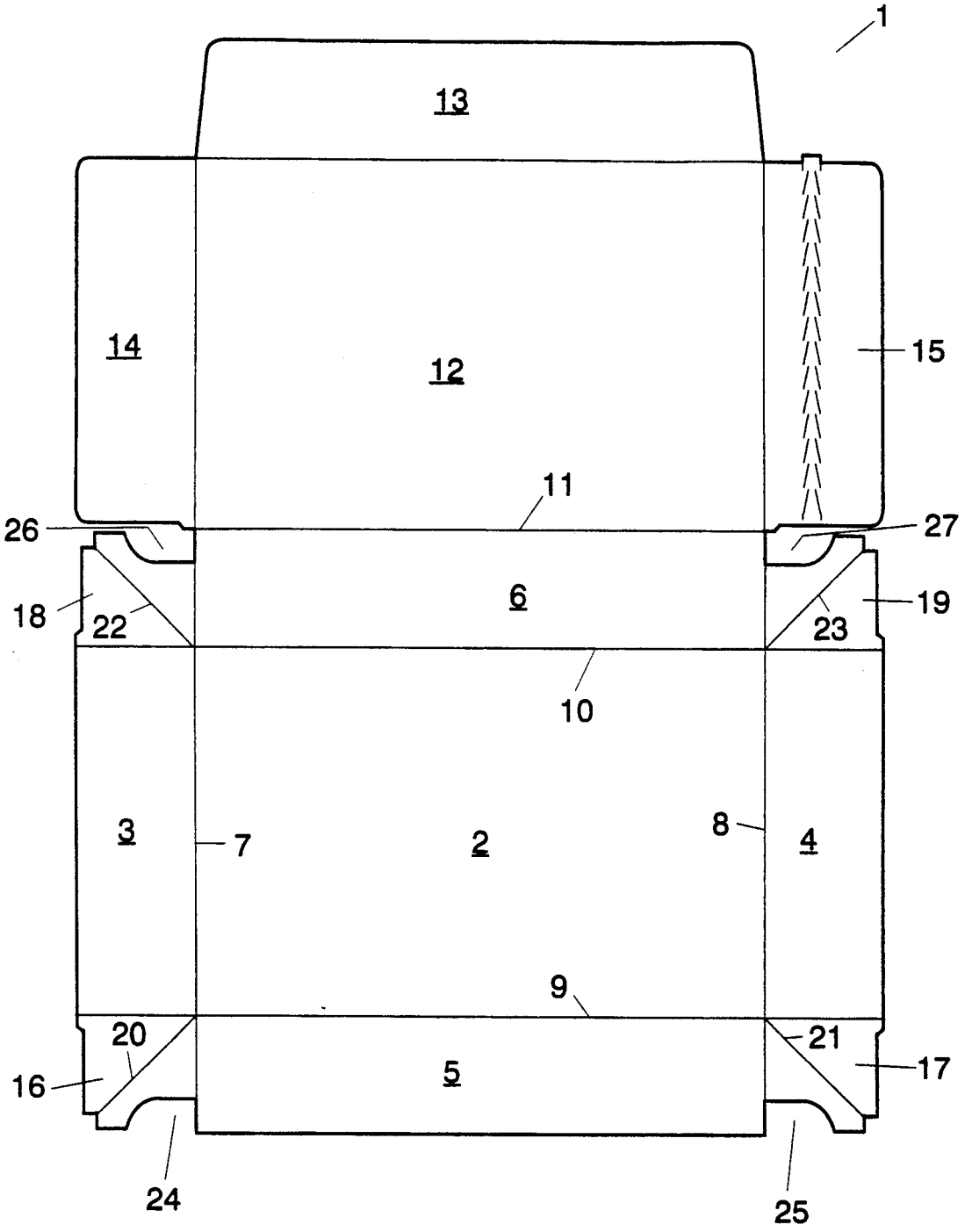
FIG. 1 shows a flat board blank.
Figure 2:
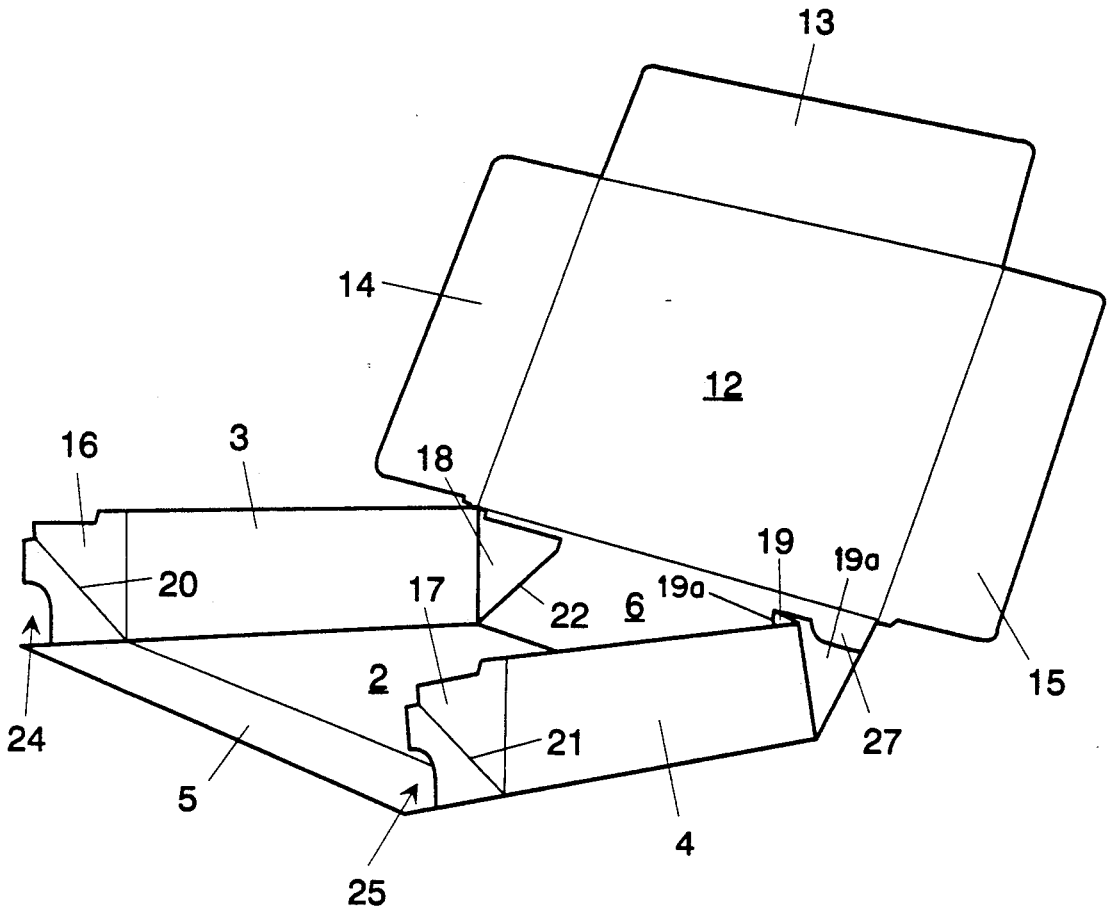
FIG. 2 shows a partly erected folding carton produced from the board blank illustrated in FIG. 1.

1 in FIG. 1 is a flat board blank, that is used to produce a folding carton and for this purpose is provided with a base 2, two side panels 3 and 4 as well as a front panel 5 and a back panel 6. The base is defined by four folding lines 7, 8, 9 and 10, along which the above-mentioned panels are hinged. A top panel 12, which is in turn provided with a front panel flap 13 and two side panel flaps 14 and 15, is hinged to the back panel 6 along a further folding line 11. Intermediate sections 16, 17, 18 and 19, that are connected to the adjacent panels along the folding lines 7, 8, 9 and 7, 8, 10, are located both between the front panel 5 and the two side panels 3 and 4 and between the back panel 6 and these two side panels. Each of these four intermediate sections is divided into two halves by a folding line 20, 21, 22, 23, each of these folding lines extending from the point of intersection of the two folding lines 7/9, 8/9, 7/10 and 8/10 to the free corner of the intermediate section concerned. Each of the intermediate sections 16, 17, 18, 19, is provided with an essentially rectangular cut-out section 24, 25, 26, 27, which begins at its outer edge and extends inwards, while the narrow side of the cut-out section is next to the front panel 5 or the back panel 6. The inner corner on the opposite side of the cutout section from the respective panel is round in shape and the narrow side that continues it is somewhat oblique, so that the cut-out section can extend favorably close to the dividing folding line 20 to 23.

When the board blank is erected into a folding carton 100, the intermediate sections 16, 17, 18, 19 are folded along the folding lines 20, 21, 22, 23 and the area provided with the cut-out section is in each case positioned against the inside of the front panel 5 or the inside of the back panel 6. The second part of the intermediate section is then folded onto the first part, so that its outside rests directly against the inside of the front panel o back panel in the area of the relevant cut-out section 24 to 27 and can be sealed to the inside of the front panel or the back panel. A secure enough seal is achieved here if only the inside of the board blank 1 forming the folding carton has a sealable coating. In spite of the cut-out section the bottom part of the folding carton formed in this way is tight up to its top edge.

After the bottom part of the folding carton has been erected, it can be filled and the top panel 12 with the panel flaps 13, 14, 15 can be folded down onto it and can be attached to the appropriate panels of the bottom part.

It will be understood that each of the elements described above, or two or more together, may also find a useful application in other types of constructions differing from the types described above.

While the invention has been illustrated an described as embodied in a board blank for the production of a folding carton, it is not intended to be limited to the details shown, since various modifications and structural changes may be made without departing in any way from the spirit of the present invention.

Without further analysis, the foregoing will so fully reveal the gist of the present invention that other can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Board blank for production of a folding carton, with a base, two side panels and also a front panel and a back panel hinged to the base, and a top panel hinged to the back panel, where the panels hinged to the base are connected by intermediate sections, each of which is divided by a folding line, wherein each of the intermediate sections is provided with a cut-out section in an area adjacent to the front panel and the back panel, so that an area of the intermediate sections adjacent to the side panels rests directly against the front panel and the back panel in an area of said cut-out section when the intermediate sections are folded into position against the front panel and the back panel, said cut-out section being substantially rectangular and forming substantially a rectangle with one narrow side abutting against an adjacent one of the front panel and the back panel, the cut-out section having an inner corner facing away from one of the front and back panels and being rounded at a distance from said folding line.

2. Board blank according to claim 1, wherein the cut-out section forms substantially a rectangle, where one narrow side of the rectangle abuts against an adjacent one of the front and back panels, while the cut-out section is located on an outer edge of the intermediate section and is thus open towards outside of the blank.

3. A board blank for producing a folding carton, comprising a base panel having a plurality of sides; a plurality of side panels each hinged to a respective one of said sides of said base panel; a top panel hinged to one of said side panels; and a plurality of intermediate sections each located between and connecting two neighboring ones of said side panels with one another, each of said intermediate sections being foldable along a folding line which divides each of said intermediate sections into a first part located adjacent to one of said two neighboring side panels and a second part located adjacent to another of said two neighboring side panels, said first part of each of said intermediate sections being provided with a cut-out adjacent to said one neighboring side panel so that said second part of each of said intermediate sections rests against said one neighboring side panel when said intermediate sections are folded, said cut-out section being substantially rectangular and forming substantially a rectangle with one narrow side abutting against an adjacent one of the front panel and the back panel, the cut-out section having an inner corner facing away from one of the front and back panels and being rounded at a distance from said folding line.

4. A board blank as defined in claim 3, wherein each of said intermediate sections have an outer edge, said cut-out being formed substantially as a rectangle with a narrow side next to said one neighboring side panel and with a wide side which is open at said outer edge.

5. A board blank as defined in claim 4, wherein each of said cut-outs has another narrow side, another wide side, and a curve between said another narrow side and said another wide side.

* * * * *